United States Patent [19]

Chin

[11] Patent Number: 4,816,971

[45] Date of Patent: Mar. 28, 1989

[54] FLASHLIGHT WITH BUILT-IN LIGHTER

[76] Inventor: Kurt L. Chin, 2Fl. No. 78, Bao Chung Rd., Hsing Dien, Taipei County, Taiwan

[21] Appl. No.: 192,151

[22] Filed: May 10, 1988

[51] Int. Cl.[4] ..... F21L 13/00

[52] U.S. Cl. ..... 362/200; 362/253; 431/253; 219/270; 219/267

[58] Field of Search ..... 362/253, 200; 431/253; 219/267, 268, 269, 270

[56] References Cited

U.S. PATENT DOCUMENTS

| | | | |
|---|---|---|---|
| D. 175,315 | 8/1955 | Quandt | 431/253 X |
| 2,075,883 | 4/1937 | Britsch | 431/253 X |
| 3,351,736 | 11/1967 | Jacobson | 219/267 |
| 3,419,705 | 12/1968 | Gordon, Jr. | 219/267 X |
| 3,711,240 | 1/1973 | Warshanw | 431/253 |
| 4,305,118 | 12/1981 | Paquette | 362/253 X |

*Primary Examiner*—Ira S. Lazarus

*Assistant Examiner*—Richard R. Cole

*Attorney, Agent, or Firm*—Morton J. Rosenberg

[57] ABSTRACT

A flashlight with built-in lighter, which is to attach a cigarette lighting device to a regular flashlight, the cigarette lighting device being composed of: a locating plate fixedly placed inside the housing of the flashlight, a heat-resistant pad fixedly attached to the locating plate, having two semi-circular protrusions to form a groove therebetween for a heating wire to be placed therein, a heat-resistant bushing placed inside a cigarette ligthing hole on the housing of the flashlight with one end fixedly attached to a locating ring that is placed on the heat-resistant pad, a heating wire with both ends fixedly attached to the locating ring and connected with a push-button switch and a power source by electric wire through a series connection thereof; by means of the above arrangement to form a flashlight for illumination and for cigarette lighting.

1 Claim, 5 Drawing Sheets

FLASHLIGHT WITH BUILT-IN LIGHTER

BACKGROUND OF THE INVENTION

A conventional flashlight is a device used exclusively for illumination. In the daytime, or at a place where the light source is sufficient, a conventional flashlight gives no help or even becomes a nuisance. Typical cigarette lighters available on the market use gas as fuel. Despite their attractive outer design, these lighters have various problems, for example:

1. Not easy to light a fire.
2. Not easy to light a cigarette because the flame of the fire is easy to extinguish by the wind.
3. They are dangerous, it is easy to burn oneself and the gas is hazardous fuel.

Because a flashlight is one of the necessities of life and there are a large population of people smoking cigarettes, to combine a flashlight and a cigarette lighter together into a consolidated unit should be a very practical idea. The present invention is to provide a flashlight with built-in electric cigarette lighter.

The objects of the present invention are:

1. To provide a flashlight with built-in electric cigarette lighter, of which the lighter is easy to use to ignite a cigarette.
2. To provide a flashlight with built-in electric cigarette lighter, of which the lighter can be used in the wind.
3. To provide a flashlight of high security with built-in electric cigarette lighter.
4. To provide a portable flashlight with built-in electric cigarette lighter which is easy to carry.
5. To provide a simple flashlight with built-in electric cigarette lighter to reduce the cost.

SUMMARY OF THE INVENTION

The present invention relates to a flashlight with built-in electric cigarette lighter, more particularly a flashlight combined with a cigarette lighting device, said cigarette lighting device comprising a heat-resistant pad that having a groove at the center with a heating wire placed therein, by means of an outer switch to control the heating of the heating wire for lighting a cigarette through a cigarette lighting hole; by means of the above arrangement to provide a portable flashlight for illumination and for cigarette lighting.

DETAILED DESCRIPTION OF THE PRESENT INVENTION

Figure 1A:
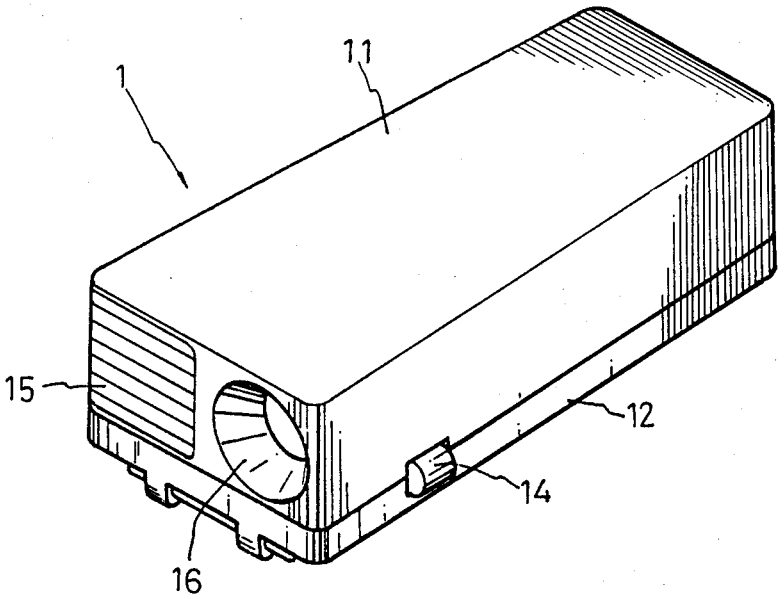
FIGS. 1A and 1B are perspective views of a flashlight with a built-in cigarette lighter embodying the present invention.
Figure 1B:
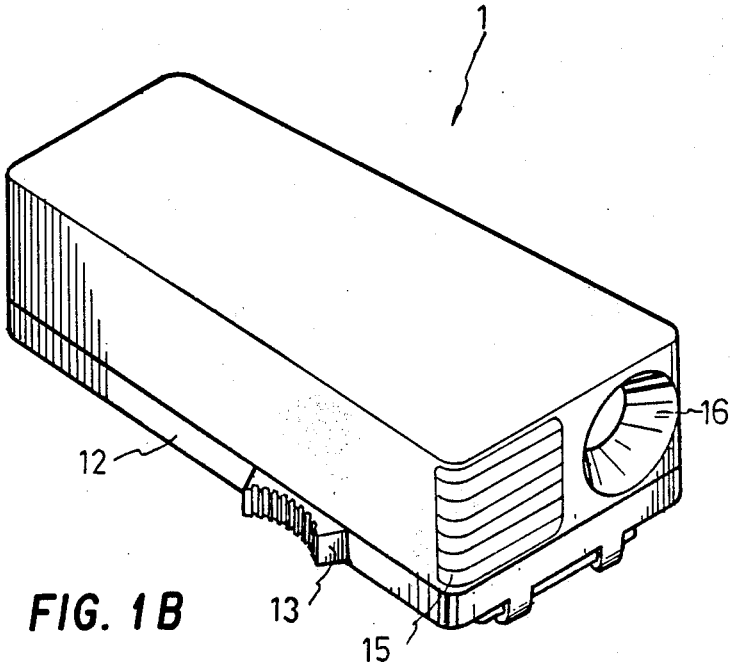

As shown in FIG. 1, the present invention has an elongate housing 1 composed of a lower housing 12 that has laterally at least one upward lug and an upper housing 11 that has at least one recess laterally aligned with the lug. The upper housing 11 and the lower housing 12 are easy to retain together by means of the lug and the recess which interfit to form the elongate housing 1 which is easy to detach for replacement of the batteries. The elongate housing 1 comprises a selector switch 13 on one side and a push-button switch 14 on the other side, respectively, for control of the lamp of the flashlight and the cigarette lighting device. The front part of the elongate housing 1 includes a transparent housing portion 15 for penetration of light and for protection of the lamp thereinside. A cigarette lighting hole 16 is arranged by the side of said transparent housing portion 15 to communicate with the heating wire that is placed thereinside.

Figure 2:
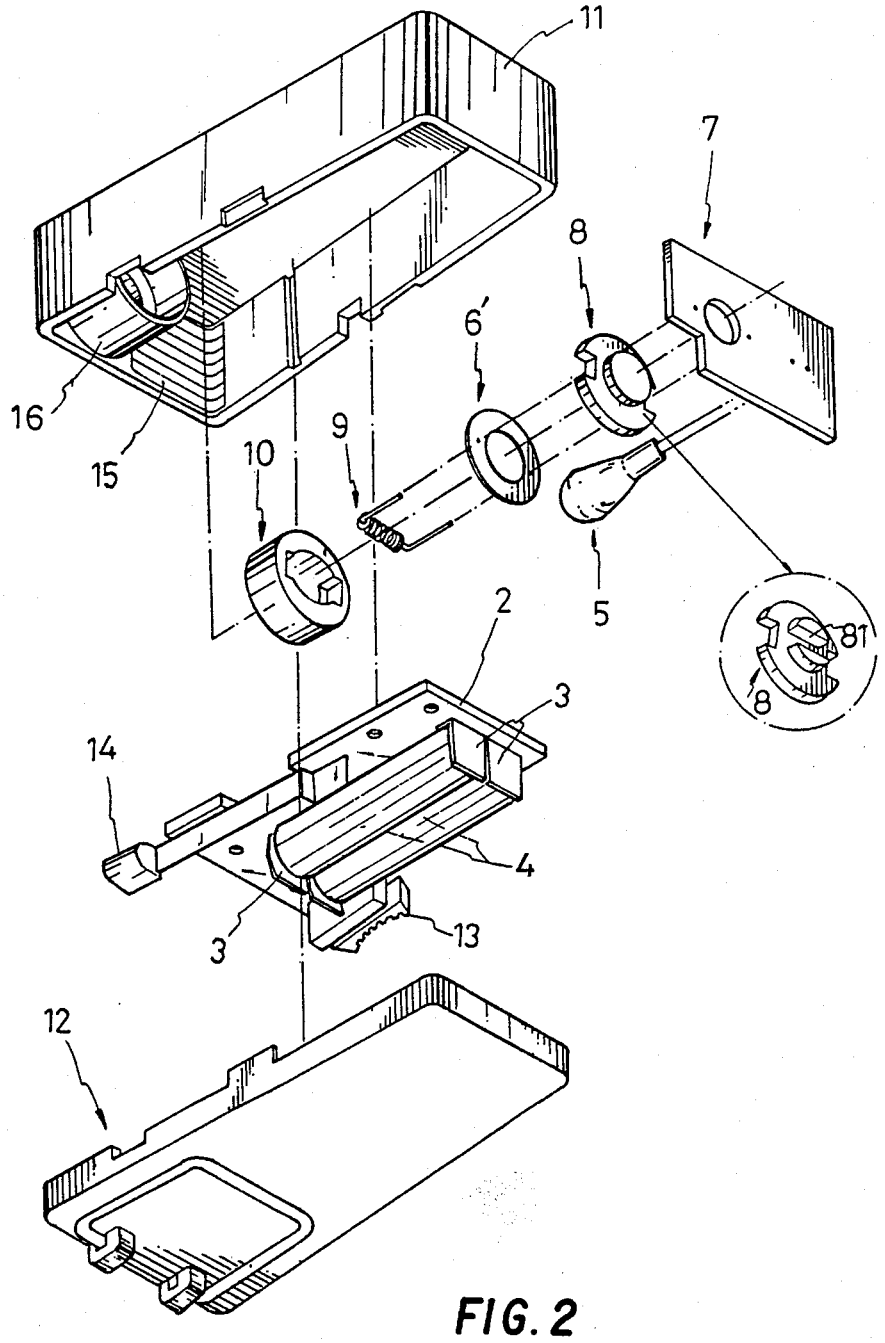
FIG. 2 is a fragmentary perspective view of the preferred embodiment according to the present invention.
Figure 3:
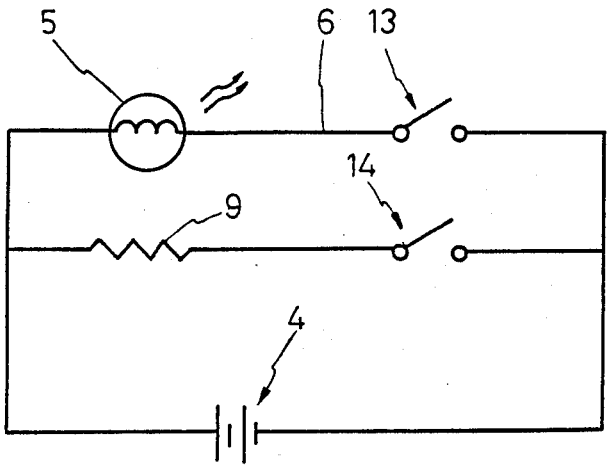
FIG. 3 is a circuit diagram for the preferred embodiment according to the present invention; and, FIGS. 4A and 4B are further perspective views of the preferred embodiment according to the present invention.

As shown in FIG. 2 and FIG. 3, the inner part of the present flashlight is composed of a circuit board 2, a battery holder 3, a pair of 1.5 volt batteries 4 positioned in the battery holder 3. The lamp 5 is connected by a selector switch 13 and by means of a conducting wire 6 to the batteries 4 in a series connection. A locating plate 7 is vertically retained inside the upper housing 11 with a heat-resistant pad 8 attached at the front, the heat-resistant pad 8 has two semicircular protrusions to form a groove 81 therebetween for the heating wire 9 to be placed therein. A heat-resistant bushing 10 is placed on the heat-resistant pad 8 with one end located inside the cigarette lighting hole 16 of the upper housing 11. The heating wire 9, supported by locating ring 6', is connected to the batteries 4 in a series connection with the push-button switch 14. By means of the above arrangement, the illuminating device and the cigarette lighting device are consolidated into a parallel circuit connection with respect to the batteries, (as shown in FIG. 3) to form a cost-reduced, safe and practical flashlight with built-in cigarette lighter.

Figure 4A:
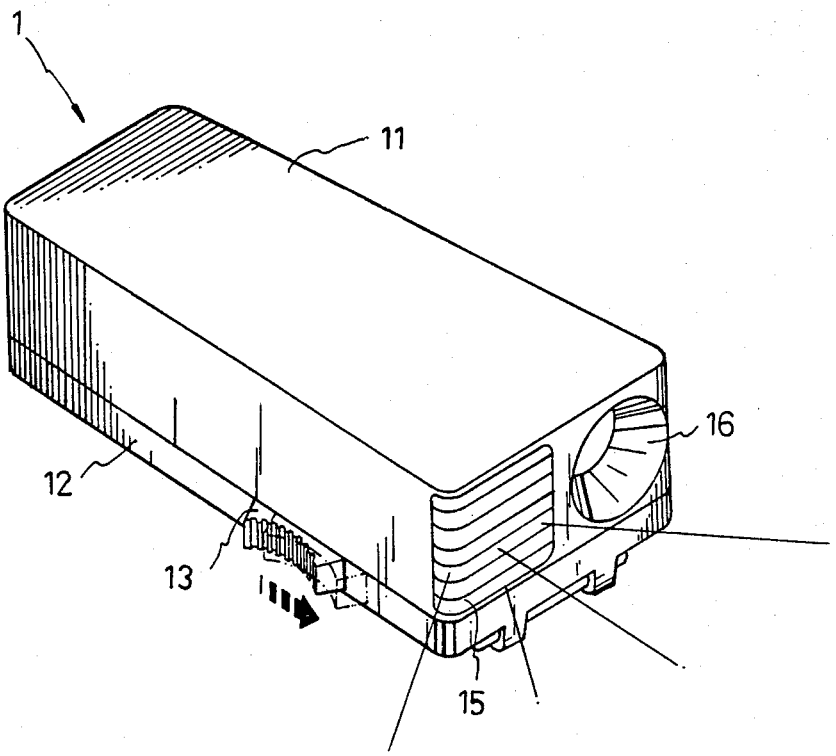

As shown in FIG. 4A, when pressing on the selector switch 13, the lamp is turned on for illumination to form a portable flashlight.

Figure 4B:
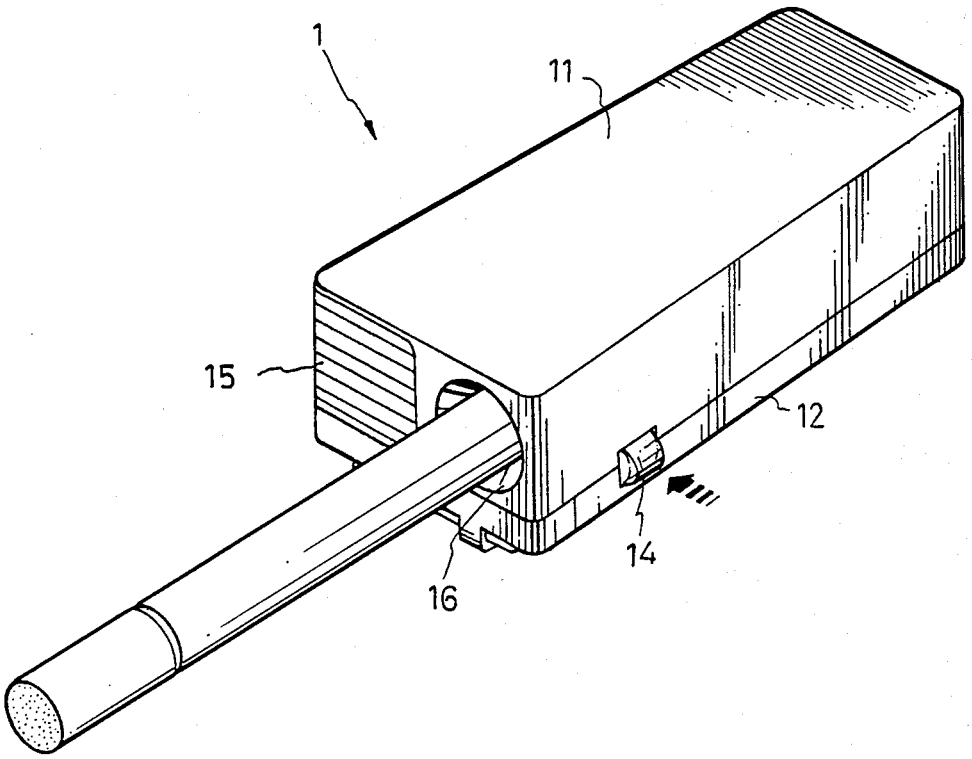

As shown in FIG. 4B, when pressing on the pushbutton switch 14, the heating wire 9 is heated by the electric current from batteries 4. Subsequently, a cigarette is inserted into the cigarette lighting hole 16 to touch the heated heating wire 9 for igniting the cigarette. By means of the arrangement of the heat-resistant pad 8 and the heat-resistant bushing 10, the elements therearound and the housing of the flashlight are well protected from heat and the user is well protected from being burned. By means of the arrangement of the heating wire, the cigarette lighting device can be well performed in the wind which provides better utility than typical gas filled lighters.

In addition to the arrangement of combining the cigarette lighting device with a flashlight, the cigarette lighting device can be constructed as an independent device or in combination with other portable electric devices, such as an electric shaver.

What is claimed is:

1. A flashlight with built-in lighter comprising:

an elongate housing comprised of an upper housing member and a lower housing member, said upper housing member having a front substantially transparent portion, said upper housing member having an aperture for cigarette lighting located adjacent said front transparent portion, said upper housing member having at least one recess for retaining a lug extending from said lower housing member to form said elongate housing;

a selector switch located laterally on one side of said elongate housing;

a battery supplied power source electrically coupled to an illuminating member and said selector switch in series combination; and, cigarette lighting means located within said elongate housing for igniting a cigarette inserted in said upper housing member aperture including:

a heat-resistant bushing member placed inside said aperture and having one end fixedly coupled to a locating ring member;

a locating plate member fixedly coupled to and located inside said elongate housing;

a heat-resistant pad member fixedly coupled to said locating plate member, said heat-resistant pad member having two semi-circular protrusions on one side of said pad forming a groove therebetween; and, a heating wire having two opposing ends supported by said locating ring member and located within said groove formed in said pad member, said heating wire being electrically connected with said push-button switch and said power source in series combination.

* * * * *